US005829987A

United States Patent [19]

Fritsch et al.

[11] Patent Number: 5,829,987

[45] Date of Patent: Nov. 3, 1998

[54] ELECTROMECHANICAL CONNECTION DEVICE

[76] Inventors: Klaus-Dieter Fritsch, Am Wiesenrain 16, D-89522 Heidenheim; Achim Bullinger, Buigenstrasse 50, D-89542 Herbrechtingen; Hermann Neidlein, Ziegelhalde 2, D-89518 Heidenheim, all of Germany

[21] Appl. No.: 875,828

[22] PCT Filed: Jul. 18, 1995

[86] PCT No.: PCT/EP95/02811

§ 371 Date: Sep. 29, 1997

§ 102(e) Date: Sep. 29, 1997

[87] PCT Pub. No.: WO96/31923

PCT Pub. Date: Oct. 10, 1996

[30] Foreign Application Priority Data

Apr. 1, 1995 [DE] Germany ..... 195 12 335.2

[51] Int. Cl.[6] ..... H01R 11/30; H01R 13/70

[52] U.S. Cl. ..... 439/38; 200/51.09

[58] Field of Search ..... 439/38, 39, 40, 439/188; 200/51.09

[56] References Cited

U.S. PATENT DOCUMENTS 3,521,216 7/1970 Tolegian .

4,317,969 3/1982 Riegler et al. .

FOREIGN PATENT DOCUMENTS

WO 92/16002 9/1992 Germany .

*Primary Examiner*—Neil Abrams
*Assistant Examiner*—Eugene G. Byrd
*Attorney, Agent, or Firm*—Welsh & Katz, Ltd.

[57] ABSTRACT

The invention concerns an electromechanical connection device comprising a switching device which can be connected to a current source via power supply contacts and comprises switching magnets. A tripping device. provided with tripping magnets, can be connected to the switching device. Switching magnets are thus moved from a rest position, against a restraining force, into an operating position, the contact between pairs of contacts and hence the electrical connection between the switching device and the tripping device being established. The switching magnets and the tripping magnets are provided with a special code. A plurality of switching magnets in the outer peripheral area of an operating slide are disposed as segments at a distance from one another. An identical number of tripping magnets with opposite polarity are likewise arranged as segments in the same peripheral area as the switching magnets in the tripping device.

10 Claims, 3 Drawing Sheets

ELECTROMECHANICAL CONNECTION DEVICE

Figure 1:
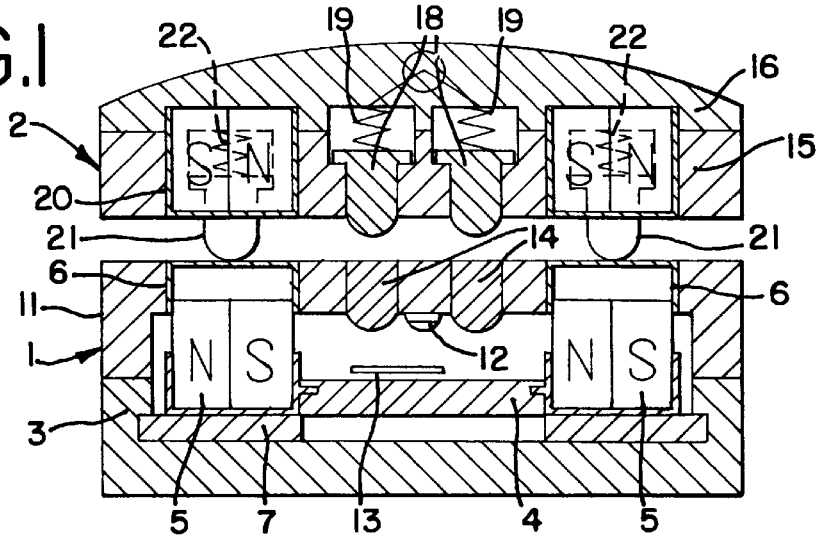

The invention relates to an electromechanical connecting device according to the type more closely defined in the preamble of claim 1.

The connecting device of this type is described in EP 0 573 471 B1. The previously known connecting device, which consists of a switching mechanism which takes over the function of a socket-outlet of conventional type, and a tripping mechanism which takes over the function of a plug, provides a connecting device which exhibits a very small overall depth and which, in addition, meets high safety requirements.

In the electromechanical connecting device according to EP 0 573 471 B1, both the mechanical and the electrical contact are performed via magnets. For this purpose, both the operating slide, which can be connected to power supply contacts, and the actuating magnet are electrically conductive. The power connection is led directly via contact hats to tripping magnets in the tripping mechanism, which are likewise electrically conductive. The magnets are surrounded on the outside by an earthing ring which is let flush into the electrically insulating housing of the switching mechanism.

It is, however, disadvantageous in this connecting device that, because of the configuration of the actuating magnets and tripping magnets as mutually corresponding annular magnets, in the event of attaching the sensor in a twisted fashion to the switching mechanism, the operating slide does not switch immediately, and thus there is no immediate current conduction.

A further disadvantage consists in that magnetic materials are heat-sensitive, and thus a short circuit would lead to loss of the magnetic components.

It is therefore the object of the present invention to improve further the electromechanical connecting device mentioned at the beginning, in particular to ensure a still greater reliability by more rapidly connecting and returning the operating slide.

This object is achieved according to the invention by means of the features named in the characterizing part of claim 1.

According to the invention, a plurality of actuating magnets are now arranged with a spacing from one another with magnet parts which have different polarities. An equal number of tripping magnets having magnet parts of opposite polarity are arranged in the same circumferential region as the actuating magnets in the tripping mechanism. Owing to the fact that the contact pins in the tripping mechanism are mounted resiliently and project in the non-connected state, there is a reliable contact in the connected state.

The actuating magnets and tripping magnets can advantageously be constructed as segments. The segments and magnet parts in this case can be arranged in corresponding groupings with a spacing from one another at the edge of a circularly constructed operating slide. In this way, relatively small rotations of the tripping mechanism have a stronger effect on the switching mechanism, since in the case of rotations the respective opposite poles of the magnets are reached earlier, as a result of which a repulsion force is produced which additionally strengthens the restoring force through the restoring spring. The overall result of this is a larger restoring force and a more rapid return of the operating slide, current conduction thereby being more rapidly interrupted and overall safety being substantially increased.

For this purpose, the magnet parts can advantageously be arranged in appropriate codings, for example in alternating north/south combinations having 180° symmetry, thus achieving a very rapid return of the operating slide in the event of rotations of the tripping mechanism. The relatively large angular lengths which occur in this case give rise even in the event of very small rotations to fields in opposite direction and thus to correspondingly high repulsion forces, with the result that the magnet slide returns to the non-connected rest state.

A further very advantageous refinement of the invention can consist in that the magnets no longer participate in the conduction of current or voltage; that is to say, they are no longer live. The current itself can be led separately via contact pairs which can be located in an inner region of the housing, to be precise between the middle of the housing and the actuating magnets. This means that only an electrically conductive bridge is required even for the operating slide which produces the contact with the power supply contacts. The operating slide itself can be electrically non-conductive together with the actuating magnets arranged thereon.

A further increase in reliability is also provided by the arrangement of the contact pairs in the inner region. Moreover, the contact pairs can be constructed to be more stable and thus more reliable, for example in the form of wide contact pins.

A further advantage is provided when the actuating magnets and tripping magnets are in contact with the earthing ring in the connected state. In this advantageous arrangement, heat which, in the event of an advantageous separation of the magnets from the current conduction, is no longer produced by the current conduction itself, but by a possible film of moisture, can be dissipated in a simple way via the earthing ring.

Figure 2:
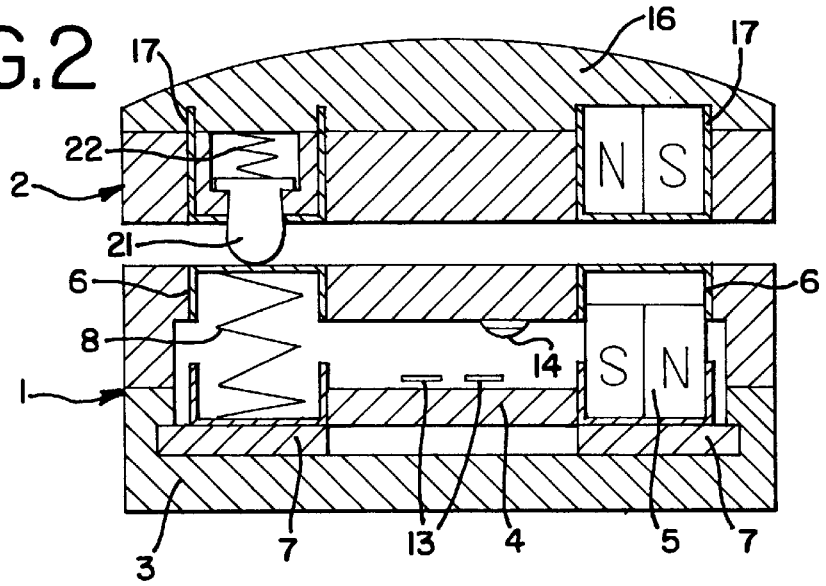
Figure 3:
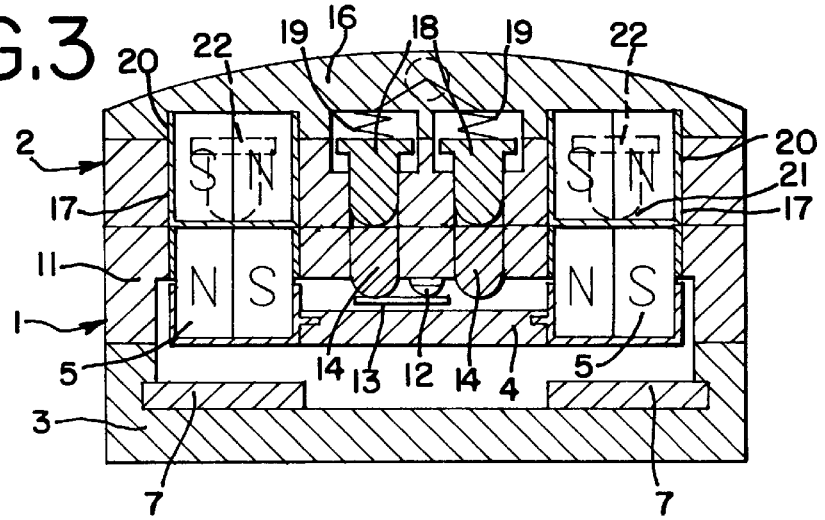
Figure 4:
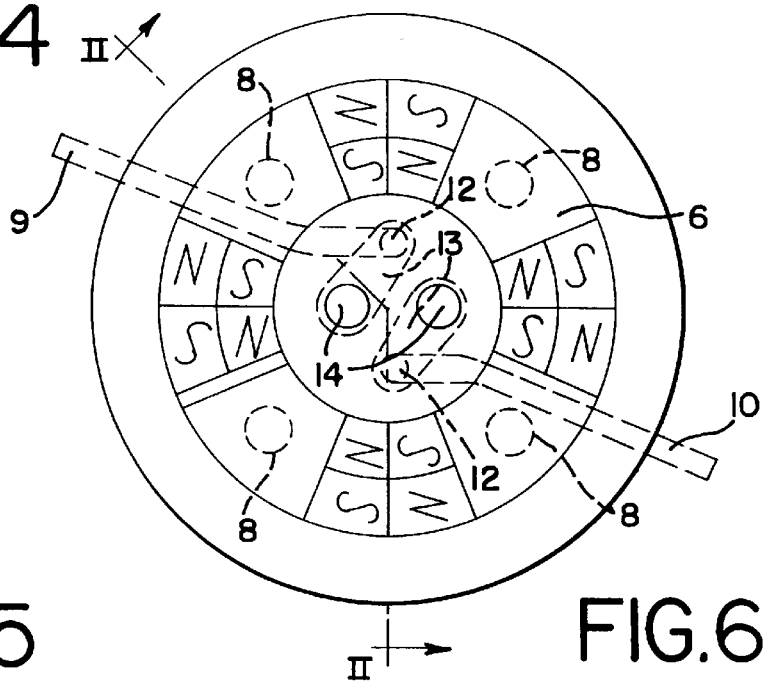
Figure 6:
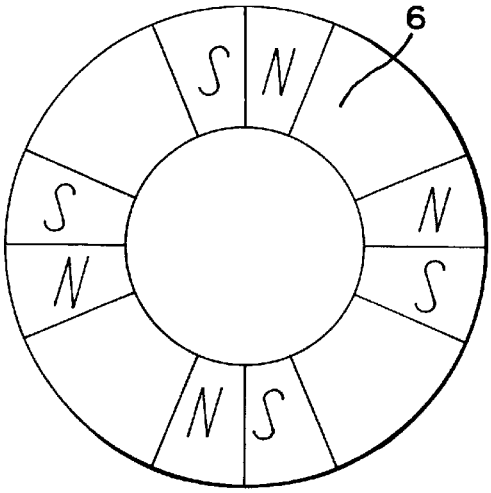
Figure 7:
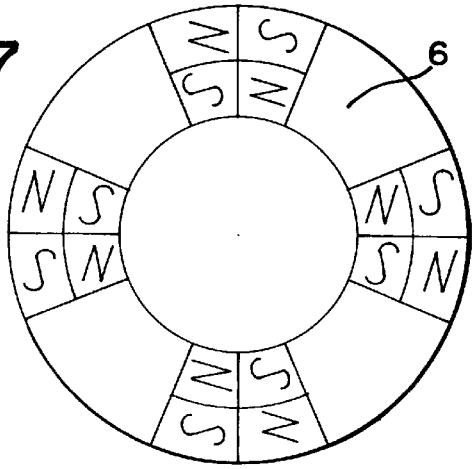
Figure 8:
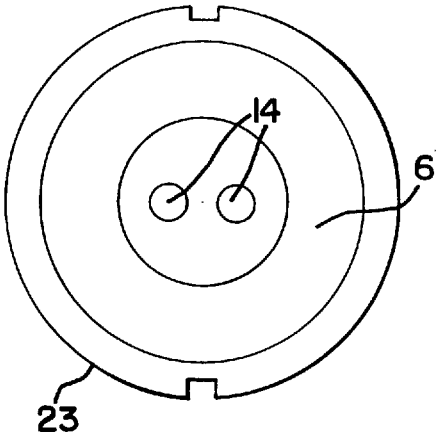
Figure 10:
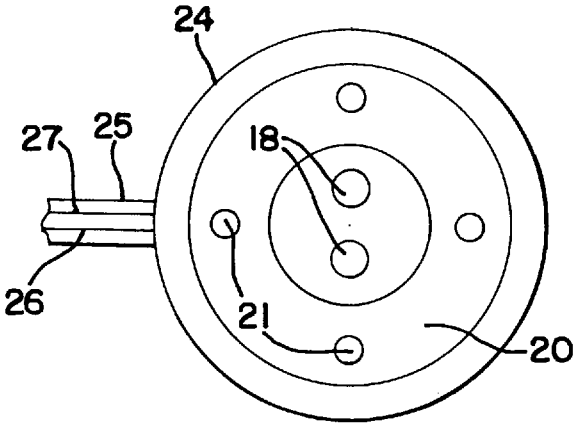
Figure 9:
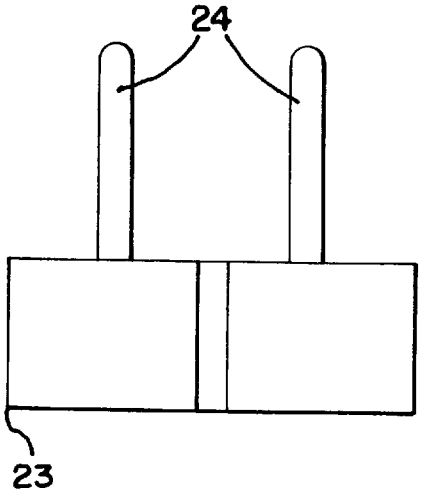
Figure 11:
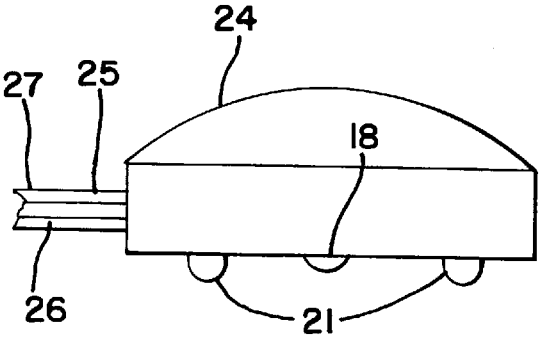

Advantageous refinements of the invention follow from further subclaims and from the following exemplary embodiments described in principle with reference to the drawing, in which:

FIG. 1 shows a longitudinal section through the electromechanical connecting device according to the invention, with a switching mechanism and a tripping mechanism in the non-connected state, FIG. 2 shows a section along the line II—II of FIG. 4, FIG. 3 shows a longitudinal section in accordance with the section according to FIG. 1, in the connected state, FIG. 4 shows a top view of the switching mechanism according to FIGS. 1 to 3, FIGS. 5 to 7 show various coding possibilities for the magnets, FIG. 8 shows a top view of an adapter (to a reduced scale), FIG. 9 shows a side view of the adapter according to FIG. 8, FIG. 10 shows a top view of a tripping mechanism in the form of a plug (to a reduced scale) and FIG. 11 shows the side view of the plug according to FIG. 10.

The electromechanical connecting device consists of a switching mechanism 1, which replaces the function of the conventional socket-outlet and is generally permanently installed at a desired point, and of a tripping mechanism 2 which replaces the function of a conventional plug which is generally connected to a consumer or which is arranged directly on the consumer. As soon as an electrically conductive connection is produced between the switching mechanism 1 and the tripping mechanism 2, the respective consumer connected to the tripping mechanism 2 is appropriately supplied with current.

In principle, the switching mechanism 1 and the tripping mechanism 2 are constructed using the same principle as for the electromechanical connecting device described in EP 0 573 471 B1. Thus, the switching mechanism 1 exhibits a closed assembly in a two-part housing 3. In the rest state, that is to say when the tripping mechanism 2 is not placed on the switching mechanism 1, an operating slide 4, on which actuating magnets 5 are arranged in the form of magnet parts having different polarities, is held on the floor of the housing 3 by a ferromagnetic retaining plate 7. The ferromagnetic retaining plate can also be a magnet ring 7.

The actuating magnets are arranged in the outer circumferential region of the circular operating slide 4. As may be seen from FIG. 4, in this case the actuating magnets 5, constructed as magnetically coded magnet parts, in accordance with the exemplary embodiment according to FIGS. 1 to 4 and FIG. 7 are arranged distributed over the circumference in a total of four quad groups. Each group thus consists of four coded magnets 5*a* to 5*d* each having two north poles and two south poles which are arranged relative to one another in such a way that in each case different polarities adjoin one another. This means that in the outer region a south pole and a north pole are situated next to one another, and in the inner region a north pole and a south pole face one another.

Each group having the magnet parts 5*a*, 5*b*, 5*c* or 5*d* coded in this way is thus arranged in the interior of the switching mechanism 1, and exhibits a height such that even in the non-connected state they are guided in a guide ring 6 at least in their upper region. For this purpose, they dip appropriately in the upper region into the guide ring 6. The guide ring 6 simultaneously constitutes an earthing ring, for which purpose it is connected correspondingly to a contact mechanism (not represented) which is connected to an earthing conductor which ends in the switching mechanism.

Four resetting springs 8 arranged distributed uniformly over the circumference ensure that in the non-connected state the operating slide 4 is additionally held on the magnet ring 7 by an appropriate spring force. At the same time, they ensure that after removal of the tripping mechanism 2 from the switching mechanism 1, or appropriate rotation of the two parts relative to one another, the operating slide 4 is brought to bear against the magnet ring 7 again. As may be seen from FIGS. 2 and 4, the resetting springs 8 are likewise guided in the guide ring 6. They are respectively located in this arrangement in free spaces between the actuating magnet.

The power supply is to be seen most clearly in FIG. 4. "9" represents a current-conducting line, and "10" a neutral conductor. The two lines are led on the inside of a cover 11 of the housing 3 to power supply contacts 12. In the connected state, an electrically conductive bridge 13 respectively produces a power connection from the power supply contacts 12 to the corresponding contact pin 14. This means that one contact pin 14 is assigned to the phase line 9, and the second contact pin 14 is assigned to the neutral conductor 10. Both contact pins 14 are arranged in the cover 11 of the housing 3 and are flush on the top side with the cover.

It may be seen from FIGS. 1 and 3 that each of the two bridges 13 is arranged elastically or resiliently on the operating slide 4, in order to compensate for tolerance inaccuracies as well as for wear, with the result that good contact is always ensured.

The tripping mechanism 2, which likewise exhibits a closed housing 15 with a cover 16, is provided with tripping magnets 17 which are likewise in each case formed from coded magnet parts. The tripping magnets 17 are arranged in the same way and at the same points in four quad groups in accordance with the exemplary embodiment according to FIGS. 1 to 4 and FIG. 7. In this arrangement, each group is constructed with reference to its polarity such that in each case different polarities face one another by comparison with the magnet parts 5*a* to 5*d* of the actuating magnets 5 of the switching mechanism 1. This means that in the case of correct positioning of the tripping mechanism 2 on the switching mechanism 1, north and south poles respectively face one another. The desired switching state, and thus the conduction of current to the consumer are achieved in this way. For this purpose, the tripping mechanism 2 is provided with appropriate lines 26 and 27 leading to a consumer, provided that the tripping device 2 is not arranged directly in or on the consumer.

Just as the contact pins 14 are arranged in a region between the middle of the housing and the actuating magnets 5, two contact pins 18 are arranged in the housing 15 in the region between the middle of the housing and the tripping magnets 17. The contact pins 18 can be displaced by springs 19 in bores of the housing 15 in such a way that they project slightly with their front ends from the housing 15 in the direction of the switching mechanism 1. This means that when the tripping mechanism 2 is supported on the switching mechanism 1, and thus in the case of electrical contact switching there is appropriate reliable contact (see FIG. 3). In this case, the contact pins 18 are correspondingly pushed back against the force of the spring 19.

The tripping mechanism 2 is likewise provided with an earthing ring 20, which faces the earthing ring 6 of the switching mechanism 1. In addition, the earthing ring 20 of the tripping mechanism 2 is provided with earthing pins 21, which are arranged distributed over the circumference and are each prestressed by a spring 22 and thus project resiliently from the housing 15 in the direction of the switching mechanism 1.

As may be seen from FIG. 1, in this arrangement the earthing pins 21 project further from the surface of the housing 15 than the contact pins 18. This means that a leading and a lagging earthing are thereby achieved during switching in a simple way.

In a similar way to the resetting springs 8 of the tripping mechanism 1 [sic], the earthing pins 21 are located in the interspaces, on the circumferential side, between the four tripping magnets 17.

As may be seen from FIG. 4, the power supply contacts 12 are likewise also located in a region between the middle of the housing and the actuating magnets 5 or the guide ring 6. In this way, not only is an electromechanical connecting device produced which has a small overall depth, but, in addition, a device is also produced which exhibits only a small diameter or width.

As has been mentioned, the earthing ring 6 serves simultaneously as guide ring for the actuating magnets 5, for which purpose said ring surrounds the actuating magnets 5 with an appropriately slight play. Reliable and non-jamming switching is ensured in this way.

Figure 5:
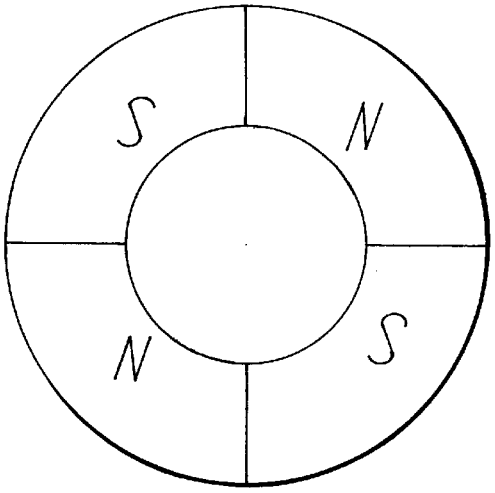

Various exemplary embodiments for the actuating magnets 5 and the tripping magnets 17 are represented in FIGS. 5 to 7.

In accordance with FIG. 5, a total of only four magnets are arranged on the operating slide 4 in quarter rings. The tripping magnets 17 of the tripping mechanism correspondingly have the opposite polarity on the circular segments.

According to FIG. 6, a north pole and a south pole are combined respectively to form an actuating magnet 5. A total of four actuating magnets are arranged distributed uniformly over the circumference.

The best solution is achieved by means of a refinement in accordance with FIG. 7, which is also described in this form in FIGS. 1 to 4. In this case, each of the four groups comprises in each case four magnet parts 5*a* to 5*d*.

The refinement yields alternating north-south combinations having a 180° symmetry. A very rapid return of the operating slide 4 in conjunction with rotation of the tripping mechanism 2 or of the switching mechanism 1 is achieved with this refinement. On the basis of the large angular lengths, fields of opposite sense, and thus repulsion forces, are produced even in the event of small rotations, as a result of which the operating slide 4 returns to its rest position and thus to bearing against the magnet ring 7. In addition, the circular structure of the operating slide 4 and also of the circular housing 3 of the switching mechanism 1 and of the tripping mechanism 2 permits a very good control of the switching movement without additional guide pins. The geometrical structure is thereby also of simpler configuration. In the case of every direction of displacement or rotation, magnetic fields of opposite sense act, and thus reliably return the operating slide 4.

An adapter 23 which permits a transition to the conventional electric system with socket-outlets with earthing contacts, or else with other socket-outlets, is represented in principle in FIGS. 8 and 9. For this purpose, the adapter 23 has pins 24 corresponding to the respective conventional system (and, if appropriate, an earthing pin as well), which are plugged into the corresponding socket-outlet of known design.

The adapter 23 is constructed in the interior in the same way as the tripping mechanism 1 [sic], only the lines 9 and 10 being replaced by the pins 24. The earthing ring 6 together with the two contact pins 14 are to be seen in FIG. 8.

Represented in FIGS. 10 and 11 is a separate tripping mechanism 2 in the form of a plug 24 which is provided with leads 26 and 27 which lead to a consumer and are surrounded in the usual way with a protective sheath 25. The plug 24 is constructed in the interior in the same way as the tripping mechanism 2. The earthing ring 20 together with four earthing pins 21 can be seen in FIG. 10.

What is claimed is:

1. An electromechanical connecting device having a switching mechanism which can be connected via power supply contacts to a current source, including actuating magnets having coded magnet parts in the form of a first specific arrangement of the north and south poles, arranged in a housing as a closed assembly, and connected to a tripping mechanism which exhibits tripping magnets having coded magnet parts in the form of a second specific arrangement of the north and south poles and electrically connectable to a consumer; said tripping magnet bringing the actuating magnets from a rest position into a working position against a retaining force for producing a contact of contact pairs and an electrical connection between the switching mechanism and the tripping mechanism, the actuating magnets cooperating by means of a coding, with the tripping magnets having oppositely directed coding, thereby realizing specific magnetic fields for the actuating operation; the housing of the switching mechanism being provided with an earthing ring on a side facing the tripping mechanism, wherein a plurality of actuating magnets are arranged in the outer circumferential region of the operating slide with a spacing from one another with magnet parts having different polarities, and an equal number of tripping magnets having magnet parts of opposite polarity are arranged in the same circumferential region as the actuating magnets in the tripping mechanism and in that the contact pairs exhibit contact pins in the switching mechanism and in the tripping mechanism, the contact pins in the tripping mechanism projecting in the non-connected state from a side facing the switching mechanism and being mounted resiliently in the tripping mechanism.

2. The electromechanical connecting device according to claim 1, wherein the actuating magnets and the tripping magnets are constructed as annular segments.

3. The electromechanical connecting device according to claim 1, wherein the operating slide is constructed at least approximately in a circular fashion.

4. The electromechanical connecting device according to claim 2, wherein a plurality of magnets, which respectively exhibit north and south poles, are arranged distributed over the circumference in the switching mechanism and in the tripping mechanism.

5. The electromechanical connecting device according to claim 4, wherein each magnet is constructed as a quad group having magnets parts of different polarity.

6. The electromechanical connecting device according to claim 5, wherein the magnet parts are arranged in alternating north-south combinations having 180° symmetry.

7. The electromechanical connecting device according to claim 6, wherein each quad group consists of two north-pole and south-pole magnet parts, south and north poles respectively facing one another radially and in the circumferential direction.

8. The electromechanical connecting device according to claim 1, wherein, in the connected state, the actuating magnets and the tripping magnets are in contact with the earthing ring.

9. The electromechanical connecting device according to claim 1, wherein the power supply contacts are arranged at least approximately in a region of the housing between the middle of the housing and the actuating magnets, the bridge being constructed as an electrically conductive support on the operating slide.

10. The electromechanical connecting device according to claim 1, wherein the earthing ring is constructed as guide ring for the actuating magnets, with lateral annular walls which project into the housing interior and surround the actuating magnets.

* * * * *